US006327984B1

(12) United States Patent
McCann et al.

(10) Patent No.: US 6,327,984 B1
(45) Date of Patent: Dec. 11, 2001

(54) NESTABLE SHIPPING PALLET WITH ADJUSTABLE DECK

(75) Inventors: Michael T. McCann, Ocala, FL (US); Daniel C. Mullock, Cincinnati, OH (US)

(73) Assignee: U.S. Plastic Lumber, Boca Raton, FL (US)

( * ) Notice: Subject to any disclaimer, the term of this patent is extended or adjusted under 35 U.S.C. 154(b) by 0 days.

(21) Appl. No.: 09/594,476

(22) Filed: Jun. 15, 2000

(51) Int. Cl.[7] ..... B65D 19/38
(52) U.S. Cl. ..... 108/53.1
(58) Field of Search ..... 108/53.3, 53.5, 108/53.1, 54.1, 51.11

(56) References Cited

U.S. PATENT DOCUMENTS

| | | | |
|---|---|---|---|
| 3,140,672 | | 7/1964 | DeLuca . |
| 3,363,590 | | 1/1968 | Cloyd et al. . |
| 3,412,502 | | 11/1968 | Riches . |
| 3,467,032 | | 9/1969 | Rowlands et al. . |
| 3,696,761 | * | 10/1972 | Brown ..... 108/53.3 |
| 3,776,145 | | 12/1973 | Anderson et al. . |
| 3,868,915 | | 3/1975 | Hafner . |
| 4,000,704 | | 1/1977 | Griffin, Jr. . |
| 4,029,023 | | 6/1977 | Rosewicz et al. . |
| 4,279,204 | | 7/1981 | Propst . |
| 4,397,247 | | 8/1983 | Lemelson . |
| 4,809,618 | | 3/1989 | Bell . |
| 4,879,956 | | 11/1989 | Shuert . |
| 5,341,748 | * | 8/1994 | Liu ..... 108/53.3 |
| 5,566,624 | | 10/1996 | Brown et al. . |
| 5,596,933 | | 1/1997 | Knight et al. . |
| 5,606,921 | | 3/1997 | Elder et al. . |
| 5,791,262 | | 8/1998 | Knight et al. . |
| 5,816,173 | | 10/1998 | Warneford . |
| 5,894,803 | | 4/1999 | Kuga . |
| 5,895,025 | | 4/1999 | Alesi et al. . |
| 5,896,818 | | 4/1999 | Phillips . |
| 5,911,179 | | 6/1999 | Spiczka . |
| 5,921,188 | * | 7/1999 | Kohlhaas ..... 108/53.3 X |
| 5,964,162 | | 10/1999 | Chuan-Jen . |

* cited by examiner

*Primary Examiner*—Jose V. Chen
(74) *Attorney, Agent, or Firm*—Robert H. Frantz

(57) ABSTRACT

A pallet having a body topped by a deck with foldable deck flaps. The deck has two or more foldable flaps near each edge of the body platform, and a center portion. With the flaps folded into their down position, the pallet provides a nearly solid upper deck support for the load articles. With the flaps folded into their stowing position, the tops of the hollow legs are exposed so as to allow other unloaded pallets to be stacked and nested upon the pallet. The flaps may be interchanged with other flaps of alternate dimensions so as to provide a pallet with adjustable deck dimensions. Multiple attachment points for the flaps such that the flaps may be attached at positions with more or less overhang from the edges of the body, providing a more convenient method of deck dimension adjustment without the need for a variety of flap sizes.

10 Claims, 8 Drawing Sheets

NESTABLE SHIPPING PALLET WITH ADJUSTABLE DECK

FEDERALLY SPONSORED RESEARCH AND DEVELOPMENT STATEMENT

This invention was not developed in conjunction with any Federally-sponsored contract.

TECHNICAL FIELD OF THE INVENTION

This invention relates to the technologies and arts of shipping pallets and supports for storage containers.

CROSS-REFERENCE TO RELATED APPLICATIONS

None.

MICROFICHE APPENDIX

Not applicable.

BACKGROUND OF THE INVENTION

It is common practice in the materials handling and distribution industries to employ load-bearing platforms, called "pallets", for movement of articles. These pallets are most often manufactured from materials including wood, plastic, metal or paper, and are stacked with articles such as packed corrugated cardboard or fiberboard boxes. Most pallets provide the capability to lift and move a stack of boxes or cartons with a pallet truck or forklift, which permits the movement of multiple articles at the same time without handling each article individually. This increases the efficiency of the article transport and reduces the likelihood of damage to the individual articles, all for the purpose of doing so at lower cost.

Designs of pallets are intended to achieve a number of objectives and sometimes those individual requirements create design conflicts and engineering trade-offs. One such trade-off is that each pallet is typically designed for a specific article or commodity group for delivery in a specific market. As such, it is required to meet the dimensional standards of the particular market sector it is being employed by. Since different market sectors have different dimensional requirements, pallet dimensions designed for one market sector often are incompatible with the requirements of other markets. For shippers sending articles to multiple markets, this increases the number of pallet types and associated expenses necessary to maintain multiple inventories. For example, cartons used for shipping a particular manufactured item may be of different dimensions than cartons designed for shipment of fresh produce, so pallets which adequately support cartons of fresh produce will not necessarily adequately support particular manufactured items.

Some pallets are designed for a onetime, temporary use and are typically constructed of lightweight and inexpensive components such as lesser quality wood beams and boards. Other pallets are designed for multiple uses and employ various materials, most commonly lumber, plastic and/or metals, to ensure structural robustness throughout the life of the pallet. Consequently, the reusable pallets typically weigh and cost more than one-time use pallets.

Because pallets usually travel in distribution together with the articles being conveyed, and because heavier objects normally cost more to handle and to transport than lighter objects, heavier pallets may considerably increase handling and distribution costs for a particular commodity. Heavier pallets may also increase the risk of injury to the cargo handler, further decreasing their utility. But, lighter weight pallets may lack sufficient structural robustness to survive even a single, arduous handling.

Another design trade-off is the need to provide a solid, stable platform easily handled by forklifts and other equipment, and yet being capable of efficient return shipment for reuse. For example, conveyed articles are very often in corrugated paper containers, also known as "cardboard boxes". These cardboard boxes perform best when fully supported by the conveying pallet, particularly when moisture is present as is common with refrigerated distribution channels. This need for full support is particularly true of the edges and corners of the boxes, which provide most of the stacking strength of the box. For efficient distribution, boxes are stacked vertically on pallets to fully cover the pallet top deck width and length. To achieve effective support to a stack of several cardboard boxes, the optimal pallet design provides a pallet deck face which is completely or almost completely solid.

In general, pallets are required to have space underneath the deck adequate for pallet handling equipment to engage, lift and transport the loaded pallet. Most pallets include some form of blocks or legs sufficient to elevate the pallet deck.

Reusable pallets usually must be returned to their point of origin for reuse. For example, shipments of a particular type of produce may be received via sea-going ship at a port city where pallets of boxed produce are unloaded from the ship hold into overland trucks. The trucks then transport the loaded pallets to inland distribution centers, and the empty pallets must be returned to the port city for reuse. As such, it is desirable that the volume of cargo space required to return the empty, unloaded pallets be significantly less than that used when conveying articles. Typical industry designs for such pallets employ a hole in the deck directly above a hollow block or leg so that when stacked vertically the pallet legs can nest like conical paper cups. The larger the leg, the more stable the loaded pallet is during handling, but holes and spaces in the deck may interfere with proper support of the boxes, particularly since the legs of the pallet are typically located at the corners and periphery of the pallet which physically coincides with the corners of the corrugated boxes nearest to the corners and periphery. Consequently, the corrugated boxes directly above these leg holes often sag or break due to the absence of support, causing packaging failure and article damage. In severe instances the boxes may not stay contained on the pallet causing a safety hazard as well as severe article damage.

Therefor, there is a need in the art for a shipping pallet which can easily accommodate the varying dimensional requirements of different products and markets without expensive or complex modification in order to avoid the expense of multiple inventories of pallets. Further, to maximize support of the conveyed articles, there is a need in the art for this pallet to have a completely or nearly solid upper deck. Preferably, this new pallet must be robust and as light in weight as possible to optimize cargo handler safety and minimize shipment costs. And, there is a need in the art for this new pallet to permit nesting in a simple fashion and for efficient return for reuse. This pallet must achieve these objectives and also perform the basic functions of a typical pallet of proper load handling without compromise or complexity.

SUMMARY OF THE INVENTION

The new pallet design provides a pallet which is lightweight, robust, highly moisture resistant. The new pallet provides complete support to the bottom of corrugated boxes yet they nest for return by using a deck equipped with foldable panels which cover the leg holes during loaded shipment. Further, the foldable panels may be easily interchanged with panels of varying widths, which allows the pallet to be used for a wider variety of carton dimensions.

BRIEF DESCRIPTION OF THE DRAWINGS

The figures presented herein, taken in conjunction with the disclosure, form a complete description of the invention in its preferred embodiment.

DETAILED DESCRIPTION OF THE INVENTION

The inventive pallet is preferably fabricated of a body topped by a deck. The body provides a spacing means, such as a plurality of hollow legs, to allow common load handling equipment such as pallet trucks and forklifts to engage and transport the pallet. The body also provides a platform upon which the deck is mounted. The deck is comprised preferably of two foldable flaps near the edge of the body platform, and also has a center portion. When the flaps are folded into their down position, the pallet provides a nearly solid upper deck support for the load articles. When the flaps are folded into their stowing position, the tops of the hollow legs are exposed so as to allow other unloaded pallets to be stacked and nested upon the pallet.

Figure 1:
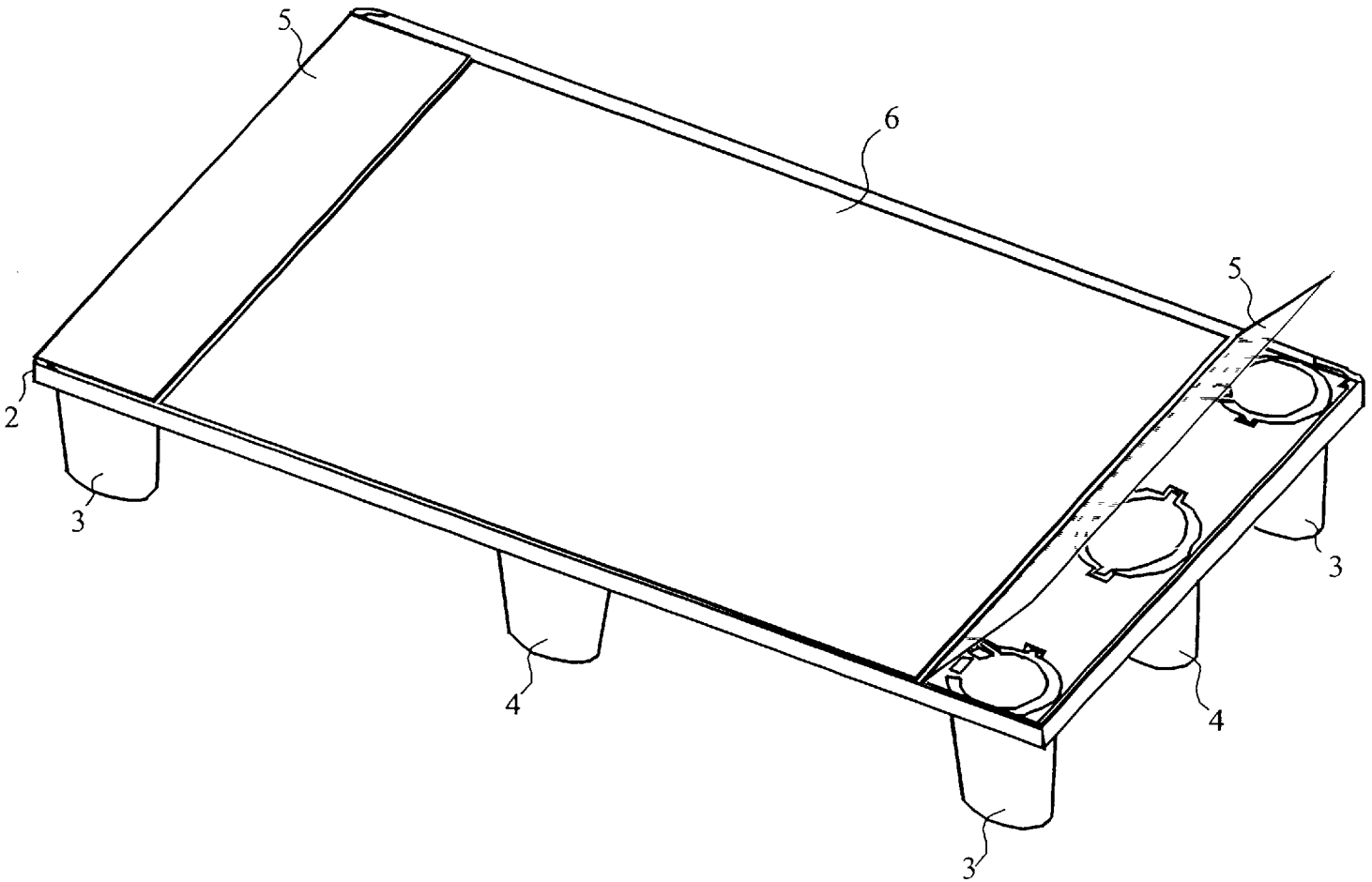
FIG. 1 shows the inventive pallet, including the nearly solid upper deck and the foldable flaps.

Turning to FIG. 1, the pallet (1) is comprised of a body with a platform (2) and a plurality of corner legs (3) and optional center support legs (4). The body is preferably fabricated of a high molecular weight, high density polyethylene ("HMWHDPE") plastic, and it may optionally be reinforced with steel for racking and handling strength. Such a body can be obtained from a number of manufacturers, such as The Fabri-Form Company of Byesville, Ohio, as described in U.S. Pat. Nos. 5,791,262 and 5,596,933, both to Knight, et al. Alternate choices of fabrication material, such as other types of plastic, metal, wood or paper products, made be selected based upon the intended use and load bearing requirements of the pallet. In the preferred embodiment, the pallet load bearing specifications including holding up to 2,000 pounds of produce in corrugated boxes with proper support to box bottoms having dimensions of 53 by 40 CM (120 by 106 CM pallet), 60 by 40 CM (120 by 100 CM pallet) and 20 by 16 inches (48 by 40 inch pallet). Additionally, the pallet must provide support to all bottom corners of boxes within 1.5" of each corner. No box side should span a gap of more than 3 inches and no edge of the box on the pallet perimeter should have more than 1 inch of gap to span. Must hold load safely in a rack across the width of 101 CM. Design load failure should be at least 2,500 lbs. when racked across 101 CM width. Adjustment of these dimensions to meet requirements of other types of commodities and articles for conveyance is within the skill of those in the art, and does not depart from the scope and spirit of the invention.

The dimensions of the pallet body in the preferred embodiment is 121 CM by 101 CM (47.54"×39.76"). However, the removable deck (5, 6) may be wider to support 106 CM wide applications, and could be slightly wider for a true 40" width in North America if necessary. The pallet overall heigh preferably does not exceed 4.73 inches (12 CM), the deck thickness preferably does not exceed 1.1 inches, and the underdeck height entering from the 121 CM side is preferably 3.6 inches (9.1 CM). Entering from the 101 CM side allows 3.3 inches clearance minimum, 3.6 inches preferred.

FIG. 1 illustrates the folding of the flaps (5), on in a transitional position so as to allow viewing of the tops of the hollow legs, and one deployed in the down position as in loaded use.

Figure 4:
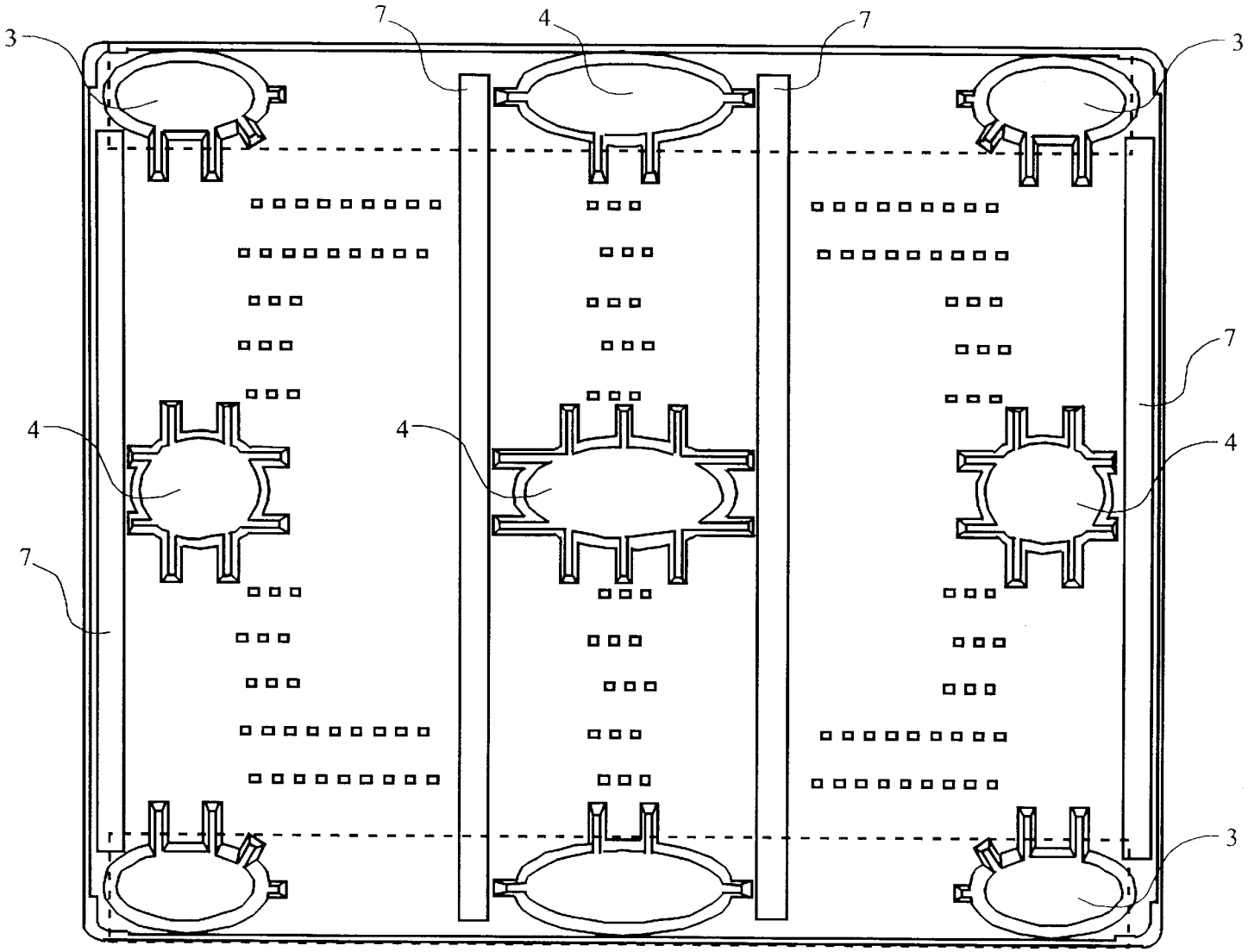
FIG. 4 discloses the bottom view of the pallet.

The preferred construction of the pallet body includes use of HMWHDPE thermoform plastic with galvanized steel tube reinforcement (7) for racking across the 101 CM span, as shown in FIG. 4, which is shown from a bottom view of the pallet. The outside legs, particularly those at the corners (3), are to be as long as possible at the bottom with the vertical outside walls as vertical as possible, and fluting is acceptable provided that the line of the wall must be straight. This is necessary for the outside leg bottoms to sit in the edge rack safely and also to travel on pallet veyors of six inch or less on center rollers. Making the corner legs as long as possible should also permit better resistance to gullwinging. Preferably, the space between the two outside legs should total 32 inches, however 29 inches is typically sufficient. The interior of the outer legs can be slanted as necessary for nesting and can also be semi-oval in shape. The inside legs are oval in shape to fit between the reinforcing tubes, and are provided with a raised center for box support. The middle inside leg may be offset to better support the corners of the two lengthwise 60 by 40 boxes, and can be a double oval or star shape for nesting in either orientation.

Figure 2A:
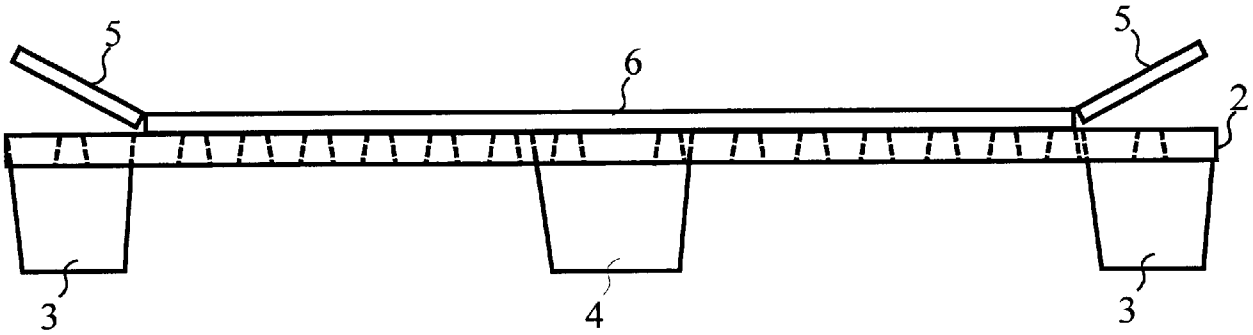
FIGS. 2, 2A illustrates two positions of the foldable flaps from an end view.
Figure 2:
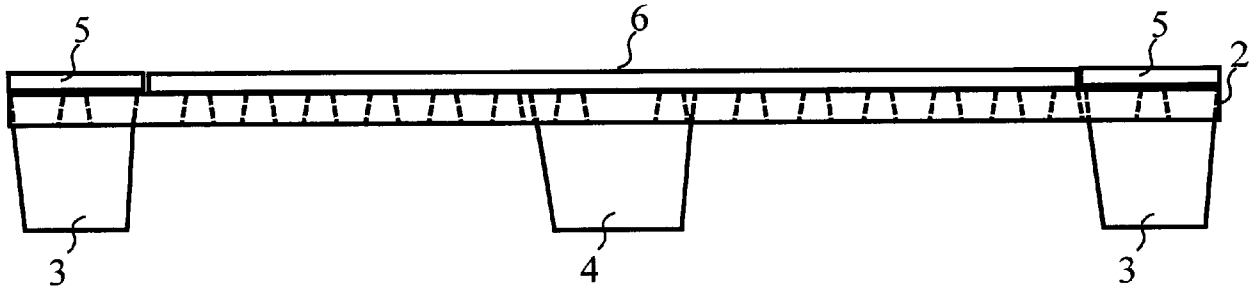
Figure 6:
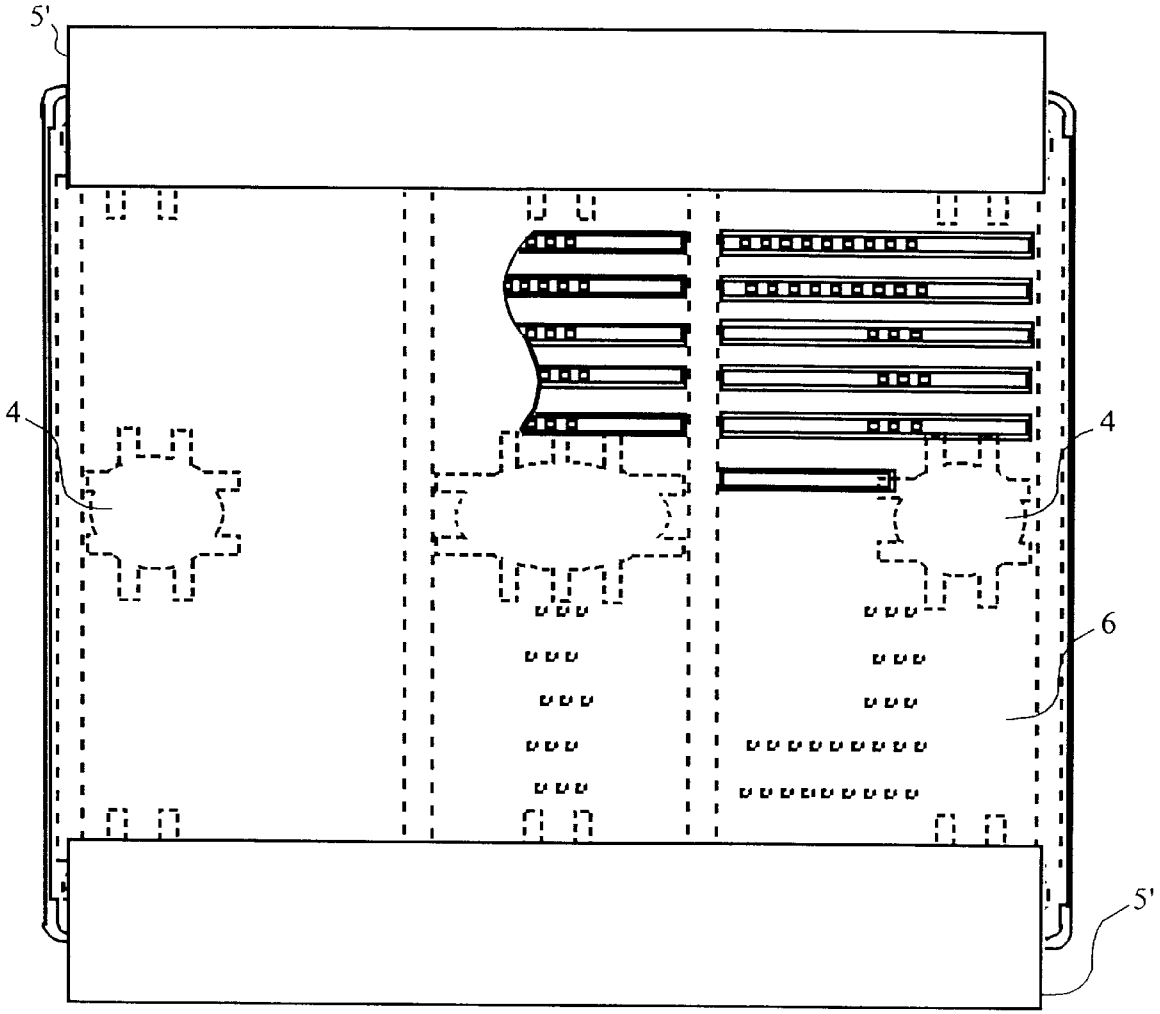
FIG. 6 illustrates the use of alternate flaps to adjust the deck width of the pallet for carrying loads of different dimensions.
Figure 7A:
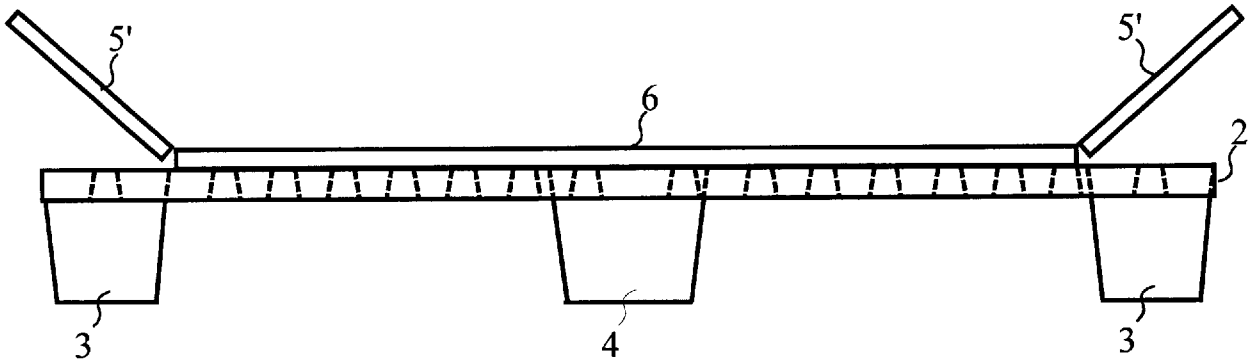
FIG. 7, 7A further illustrates the operation of the alternate flaps from an end view.
Figure 7:
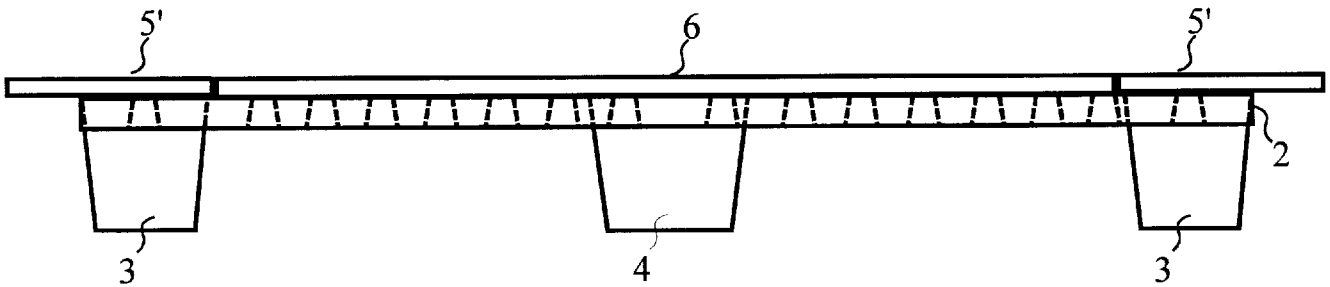

The 121 CM edge of the pallet top deck (6) is recessed so that the very large openings for the outside legs can be covered by the removable, foldable panel (5). FIG. 2 shows end views of the pallet, illustrating the foldable panels (5) in their down position for article loading, and in their transitional state being folded. The panels when in their down position give full box bottom support along the 121 CM edge. When not in place it permits easy nestability. The flaps can be replaced with boards that have somewhat greater overhang (5') to allow better box fit with different configurations, as shown in FIG. 6. FIG. 7 shows the wider flaps (5') in their down position, illustrating the overhang to achieve wider deck width, and in a transitional position to illustrate the folding action. These panels preferably fabricated of plastic lumber approximately 0.3 inches thick, matching the same depth of the deck recess.

Figure 3:
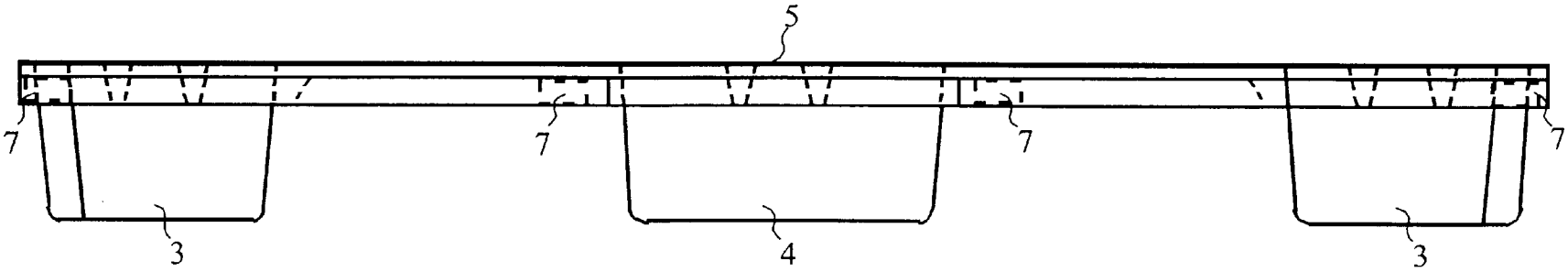
FIG. 3 presents a side view of the pallet.

The rack tubes (7) in the preferred embodiment are relatively flat and wide to reduce deck thickness. FIG. 3 illustrates the positioning of the rack tubes (7) from a side view of the pallet, and FIG. 4 shows their position from a bottom view of the pallet, both views being of the preferred embodiment. In order to make the rack tubes (7) stronger at their midpoint, a second section of tube can be attached to them. Since the tubes are inside the outer legs and since the second section would be aligned with the optional inside legs, they do not reduce underdeck clearance. As an alternative a plug-in-sleeve of metal or even plastic lumber may be inserted to the middle of the tube for improved strength.

Figure 5:
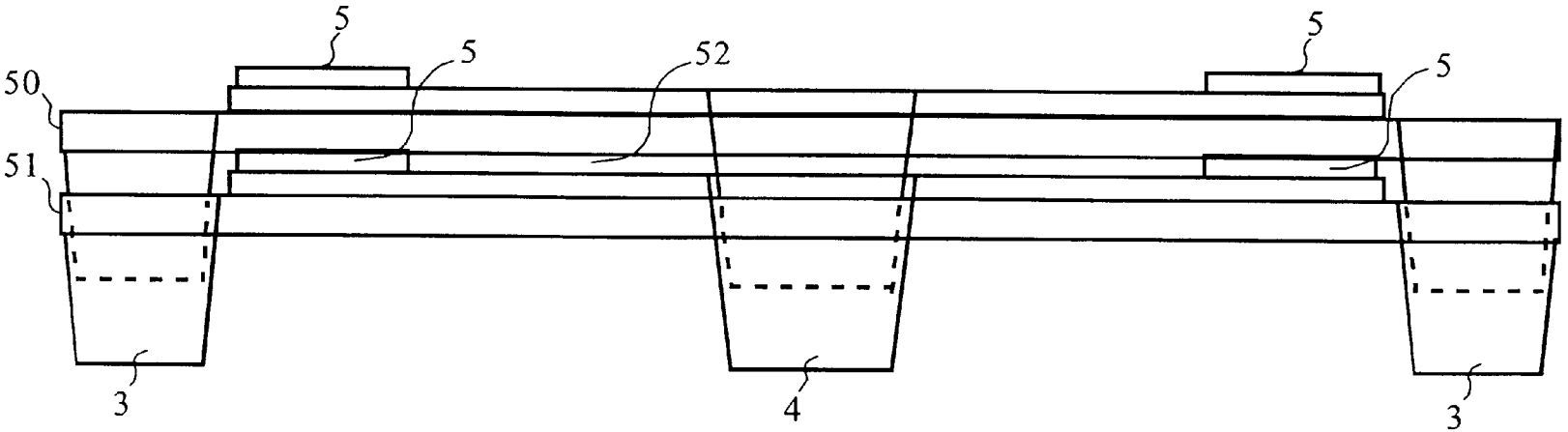
FIG. 5 shows how the pallets may nest for efficient storage and shipment.

To support efficient storage and return transportation of the unloaded pallets, the pallets preferably should nest at least 60% in height, with the foldable deckboard (5) in between the pallet bodies, as shown in FIG. 5. The greater the nesting height reduction, the better, and preferably, the pallets nest without regard to positional reversing.

Figure 8:
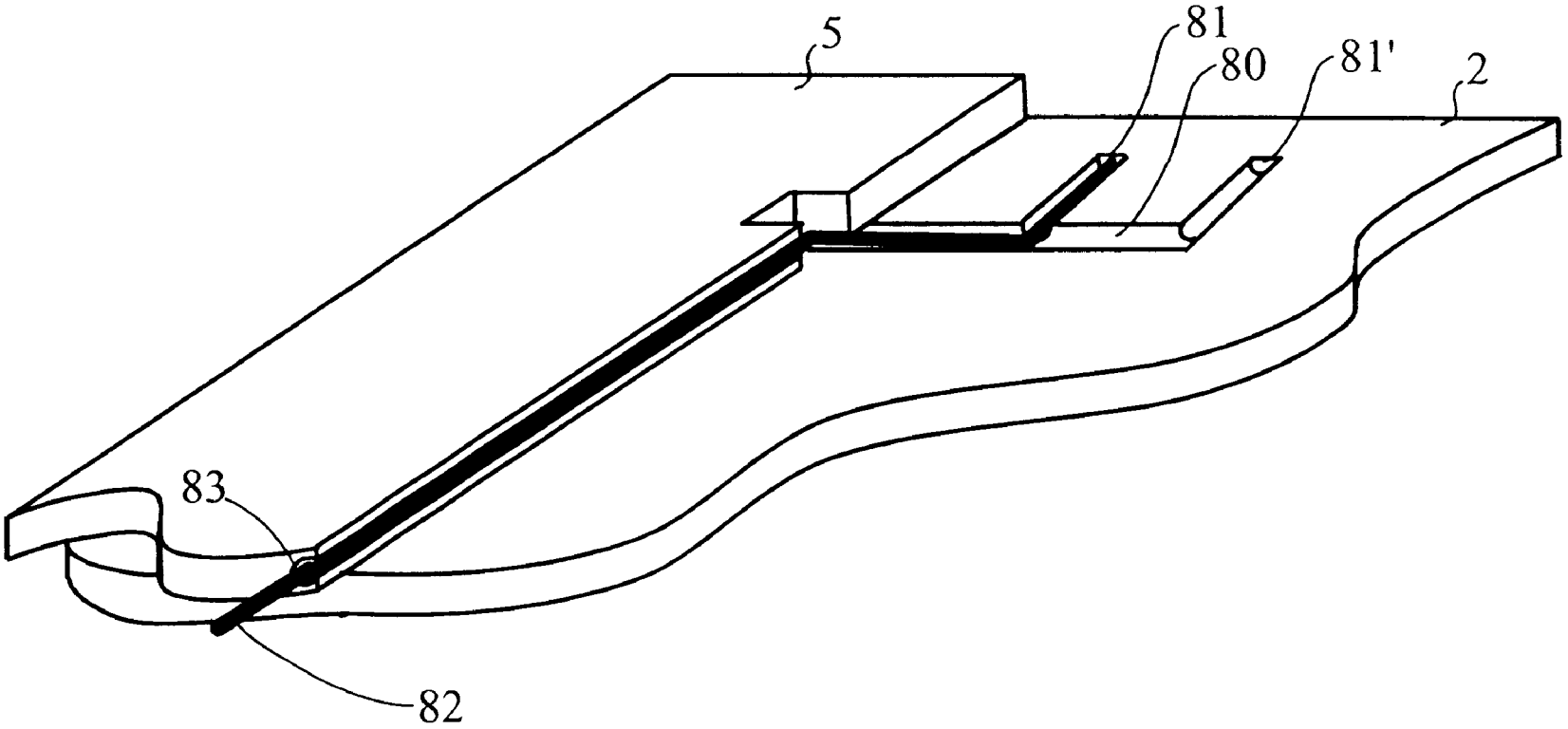
FIG. 8 shows an alternate hinge design of the flaps.

Several methods and devices are available in the art for forming the hinges between the foldable panels and the body. For example, towards the hinging edge of the foldable panel can be drilled or formed one or two holes, and corresponding holes may be formed at an adjacent or nearby position in the body. Through a plastic loop can be formed using a cable tie, such as Model number 45-308 from Gardner Bender of Milwaukee, Wis. This types of cable ties are strong and easy to install by hand, but are inexpensive so that they can be simply cut and discarded for removal. In the preferred embodiment, another hinge design is used, as shown in FIG. 8. One or more thin metal rods (82) are affixed along the hinge edge of the foldable panel (5). The rods may be affixed to the edge of the panel using a snap-fit groove (83) molded into the edge of the panel. The ends of the rod or rods are formed into an "L" shape, as shown, which protrude from the edge of the foldable panel towards the center of the pallet. A corresponding channel (80) is molded into the body for receiving the "L" shaped end of the rod(s) (82). This may also be a snap-fit design, and may be enhanced by providing a hole at the end of the channel through which the tip of the "L" shaped end of the rod may extend. The channel (80) is preferably provided with two or more attachment positions (81 and 81'), which allow the rod end to be easily removed from one position and snapped into another position. Because the various attachment points are located a different distances from the center of the pallet, the use of multiple attachment points allows the width of the pallet to be adjusted by simply moving the foldable panels from one attachment point to another, thus avoiding the need for multiple panels of varying widths.

In the preferred embodiment to support conveyance of cardboard containers of fresh produce, the pallet is provided with a number of ventilation holes to permit vertical airflow, ideally at the flap gap locations of the expected produce boxes, such as banana boxes at 60 by 40 and 53 by 40 patterns. The vent holes do not have to be larger than 1 inch in diameter, and can be less or eliminated if the pallet application does not indicate a need for ventilation. FIG. 6 illustrates one possible ventilation hold pattern, with holes in the pallet body corresponding to holes or slots in the deck.

While the disclosure contained herein has set forth a preferred embodiment of the invention, and the fundamental components and materials used within the invention are well known within the art, it will be appreciated by those who are skilled in the art that variations to the combination of elements, construction techniques and dimensions disclosed can be made without departing from the scope and spirit of the invention.

What is claimed is:

1. A stackable, nestable pallet for bearing and positioning a load on a support surface, comprising:

a main pallet subassembly having a generally rectangular body having an upper surface and a lower surface, a plurality of hollow spacing members depending from said lower surface providing a space between said support surface and said lower surface, said hollow spacing members open for mechanical nesting reception of similar such hollow spacing members from other similar pallets, said main pallet subassembly further including a deck center portion integral to or affixed to said upper surface of said body, said deck center portion having a top load surface and at least two side edges; and at least two foldable flap members removably and rotatably affixed to said main pallet subassembly such that said flap members may be placed in one of at least two positions, the first position in a down position coplanar with said top load surface of said deck center portion thereby providing a load bearing surface covering said hollow spacing members, and the second position in a stowage position folded so as to expose said hollow spacing members for said reception of other nestable pallets for stacking of a plurality of pallets.

2. A stackable, nestable pallet as set forth in claim 1 further comprising a set of expansion flaps suitable for removable rotatable installation along said deck center portion side edges, said expansion flaps having a width such that dimensions of the realized load bearing surface is greater than dimensions of the pallet body when the expansion flaps are positioned in a down position coplanar with said top load surface of said deck center portion, thereby providing a pallet with adjustable load bearing surface dimensions.

3. A stackable, nestable pallet as set forth in claim 1 wherein said body is comprised of high molecular weight, high density polyethylene ("HMWHDPE") thermoformed plastic.

4. A stackable, nestable pallet as set forth in claim 1 wherein said flap members are comprised of plastic lumber flaps.

5. A stackable, nestable pallet as set forth in claim 1 wherein said body further comprises one or more rack tubes for structural reinforcement of the pallet.

6. A stackable, nestable pallet as set forth in claim 1 further comprising one or more hinges disposed between each foldable flap member and said main pallet subassembly such that the hinges provide a means for rotatable affixation.

7. The stackable, nestable pallet set forth in claim 6 further comprising a plurality of hinge attachment points on said main pallet subassembly, and wherein said hinges are removably affixed to said main pallet subassembly at one of a plurality of attachment points and may alternately be removed and reattached to alternate attachment points, thereby allowing the flaps to be positioned with varying degrees of overhang from the main pallet subassembly.

8. A method of producing a stackable, nestable pallet for holding and conveyance of cargo, able to support a load of cargo on a support surface and compatible with general cargo handling equipment such as forklifts and pallet trucks, said method comprising the steps of:

forming a main pallet subassembly having a generally rectangular body, an upper surface and a lower surface, a plurality of hollow spacing members depending from said lower surface for providing a space between said support surface and said lower surface, said hollow spacing members formed open towards said upper surface for mechanical nesting reception of similar such hollow spacing members from other similar pallets;

providing on said main pallet subassembly a deck center portion integral to or affixed to said upper surface of said body, said deck center portion having a top load surface and at least two side edges; and affixing at least two foldable flap members to said main pallet subassembly such that said flap members may be placed in one of at least two positions, the first position in a down position coplanar with said top load surface of said deck center portion thereby providing a load bearing surface covering said hollow spacing members, and the second position in a stowage position folded so as to expose said hollow spacing members for said reception of other nestable pallets for stacking of a plurality of pallets.

9. The method of producing a pallet of claim 8 further comprising:

providing on said main pallet subasssembly a plurality of hinge attachment points such that said flap members may be removably affixed to said main pallet subassembly with varying degrees of overhang from the main pallet subassembly; and setting a top load surface dimension including said flaps by attaching said flap members at one of said plurality of hinge attachment points.

10. The method of producing a pallet of claim 9 wherein said step of providing a plurality of hinge attachment points comprises providing manually operable hinge attachment points.

* * * * *